United States Patent [19]

Bühler et al.

[11] Patent Number: 4,544,345

[45] Date of Patent: Oct. 1, 1985

[54] DEVICE FOR THE PRODUCTION OF MOLDED ARTICLES FROM A POURABLE SUBSTANCE

[75] Inventors: Eugen Bühler, Burtenbach; Klaus Strobel, Selb; Karl Schwarzmeier, Selb-Oberweissenbach NR. 89, all of Fed. Rep. of Germany

[73] Assignees: Eugen Bühler, Burtenbach; Hutschenreuther AG, Selb, both of Fed. Rep. of Germany

[21] Appl. No.: 434,354

[22] Filed: Oct. 14, 1982

[30] Foreign Application Priority Data

Nov. 10, 1981 [DE] Fed. Rep. of Germany ..... 3144678

[51] Int. Cl.[4] ..... B28B 3/08

[52] U.S. Cl. ..... 425/405 R; 264/571; 264/102; 425/352

[58] Field of Search ..... 249/57, 60, 66 A, 67, 249/105, 108, 184; 425/405 R, 352, 405 H; 264/571, 101, 102

[56] References Cited

U.S. PATENT DOCUMENTS

| | | | |
|---|---|---|---|
| 2,733,493 | 2/1966 | Bryer | 249/66 A |
| 3,252,683 | 5/1966 | Uetzmann | 249/57 |
| 4,307,866 | 12/1981 | Brown | 249/67 |
| 4,334,663 | 6/1982 | Ponginibbio | 249/105 |
| 4,417,864 | 11/1983 | Shigeo | 425/405 R |

FOREIGN PATENT DOCUMENTS

| | | |
|---|---|---|
| 695327 | 8/1953 | United Kingdom . |
| 1489462 | 10/1977 | United Kingdom . |

*Primary Examiner*—Jan Silbaugh

*Attorney, Agent, or Firm*—Toren, McGeady, Stanger, Goldberg & Kiel

[57] ABSTRACT

In the production of molded articles from a pourable substance, such as a porcelain substance, a hollow mold space is formed between a pair of horizontally displaceable compression mold parts. In the closed molding position, the mold parts are is spaced relation and form an annular gap laterally enclosing the mold space. An annular member forms a closure for the gap. The pourable substance is introduced into a passage through the closure member and through the gap into the mold space. A vacuum system is provided in the closure member in communication with the mold space during the step of filling the pourable substance into the mold space.

8 Claims, 3 Drawing Figures

FIG. 1
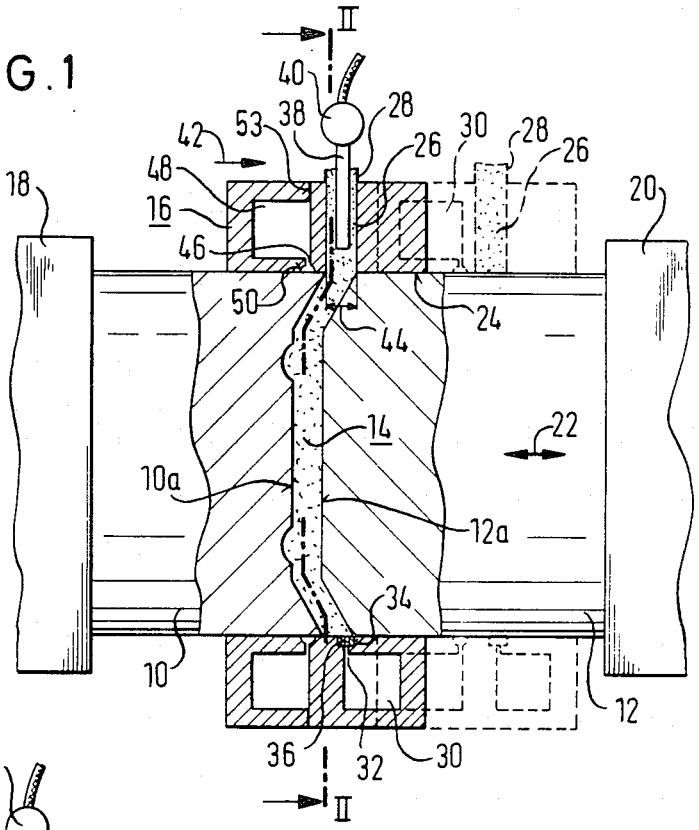
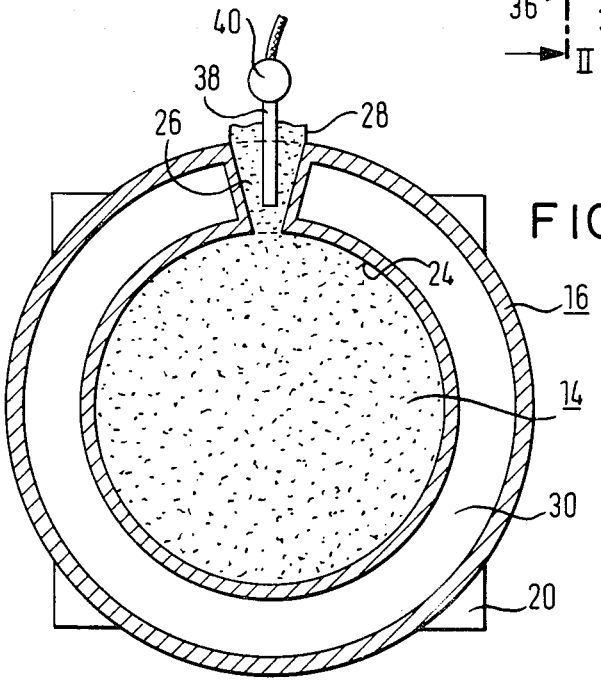
FIG. 2

DEVICE FOR THE PRODUCTION OF MOLDED ARTICLES FROM A POURABLE SUBSTANCE

SUMMARY OF THE INVENTION

The present invention is directed to a method of and a device for the production of molded articles from a pourable substance, in particular an oxide ceramic substance or a porcelain substance. The pourable substance is introduced into a hollow mold space formed between compression mold parts movable in the horizontal direction between open and closed positions.

A method of this general type is known for the production of flat dinnerware, such as dishes and plates. The method has the advantage that the supply of the pourable substance into the hollow mold space is aided by gravitational force and similarly the removal of the molded article from the hollow mold space can be effected by gravitational force by permitting the article to fall on a cushioned surface.

The primary object of the present invention is to further accelerate the process of filling the material into the mold space in such a method and to aid the complete and uniform filling of the hollow mold space with the pourable substance.

In accordance with the present invention, a vacuum is maintained within the hollow mold space during the filling operation. Filling a hollow mold space under the influence of a vacuum has been proposed in German patent applications P 31 01 236.1; P 31 28 347.0 and P 31 28 348.9.

In accordance with the method embodying the present invention, the pourable substance is introduced into the crown of a closure gap encircling the mold space between a pair of compression mold parts. The vacuum is applied to the closure gap at least along one part of the remaining circumference of the gap. The provision of the vacuum in this manner is very advantageous because it aids in the uniform filling of the overall mold space by providing an equal distribution of the suction action over the maximum possible extent of the remaining circumference of the gap with the exception of the material inlet opening.

To improve the uniform distribution of the pourable substance throughout the hollow mold space, fluidized air can be introduced with the pourable substance, preferably as it is introduced into the mold space, for placing the substance in a fluidized state. The fluidizing air can be atmospheric air or air under pressure. It is important that the velocity of the particles of the fluidized substance and the suction action are adjusted relative to one another so that the velocity of the particles in the direction of the vacuum connection is not too great. Excessive velocities can cause the grains of the pourable substance, for instance, grains resulting from the spray drying of a liquid porcelain substance, to be broken up at the points where the vacuum is applied causing the blockage of the vacuum and impeding the uniform distribution of the pourable substance throughout the hollow mold space. Therefore, it is a significant feature of the method embodied in the present invention that the introduction of the pourable substance only takes place when the vacuum is applied so that the velocity of the substance does not result in obstruction of the vacuum application locations.

While it is not absolutely necessary, it is of particular advantage for the production of high quality molded articles that the vacuum is maintained or is reestablished during the compression step following the introduction of the substance into the mold space.

The present invention also is directed to a mold device for carrying out the method including a pair of horizontally movable compression mold parts arranged so that they define a laterally open mold space between them in the closed or filling position of the mold.

Such devices are known.

In accordance with the present invention, the device is arranged to permit filling of the hollow mold space in brief cycles.

In accordance with the present invention, the compression mold parts are arranged in the closed position so that a lateral open gap is provided between them and an annular member forms a closure for the gap. The closure member includes a filling passage or opening into the gap as well as means for providing a vacuum. The closure member is axially displaceable between a filling position and a compressing position. In the filling position the vacuum is introduced around the circumference of the border gap between the opposite sides of the filling passage or opening.

For providing a uniform distribution of the pourable substance over the entire mold space, the vacuum is connected through at least one partial annular groove formed in the inner circumferential surface of the closure member, preferably a partial annular groove extending around the entire circumference of the closure member with the exception of the circumferentially extending space taken up by the filling passage. In the filling position, the closure member overlaps the gap formed between the mold parts.

The method and device in accordance with the present invention are suitable for preliminary compression as well as final compression of the molded articles. If only a preliminary compression of the molded article is effected, the final compression can be performed in another press after the article is removed. It is preferable, however, if the final compression also takes place in the device embodying the present invention. If the final compression is effected in the device, then the connection of the filling passage or opening to the hollow mold space through the lateral gap could lead to imperfections or marks left on the surface of the molded article during the subsequent processing operations. Such imperfections or markings on the molded article, such as a piece of dinnerware, are disturbing because they cannot be completely removed or because the means for removal require additional expenditure. Therefore, it is proposed that during the pressing operation that the filling passage is closed so that no marks are left on the molded article. The closing of the filling passage can be achieved in a simple and speedy manner by displacing the closure member during the pressing operation so that the filling passage is displaced out of alignment with a lateral gap opening into the mold space.

If it is desired that the vacuum system is connected to the gap during the pressing operation as well as during the filling operation, this can be effected by providing at least one additional partial annular groove in the inner circumferential face of the closure member so that this second groove coincides with the lateral gap when the closure member is moved for performing the pressing operation.

The vacuum system provided in the closure member can be formed by at least one annular channel. If partial annular grooves are located in two different planes through the closure member, then, to provide a connection of the vacuum system with the hollow mold space both during the filling operation and the pressing operation, the grooves located in different planes can be connected to two different annular channels each connected together or separately to a pump or to a vacuum container.

Concerning the problem mentioned above of the obstruction of the vacuum openings into the hollow mold space, because of excessively high acceleration of particles of the pourable substance, as the case may be, it is advantageous to provide the connection of the vacuum system to the lateral gap about the mold space, which is effective during the filling operation, with a mesh insert or the like which prevents an obstruction of the connection due to the fluidized substance. The mesh insert can be formed of a molded member with fine holes, for example, a porous sintered member.

In the present invention, the closure member in the pressing position defines the lateral surface of the mold space, that is, it extends circumferentially around the mold space, accordingly, it is possible to provide the closure member about its inner circumferential surface with a recess forming a part of the mold space in the pressing position, in particular, an annular recess, for forming a bead-shaped border around the outer edge of the molded article.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a side view, partly in section, of a device embodying the present invention with the device illustrated in the filling position;

FIG. 2 a sectional view taken along the line II—II in FIG. 1 illustrating the filling position.

DETAIL DESCRIPTION OF THE INVENTION

Figure 3:
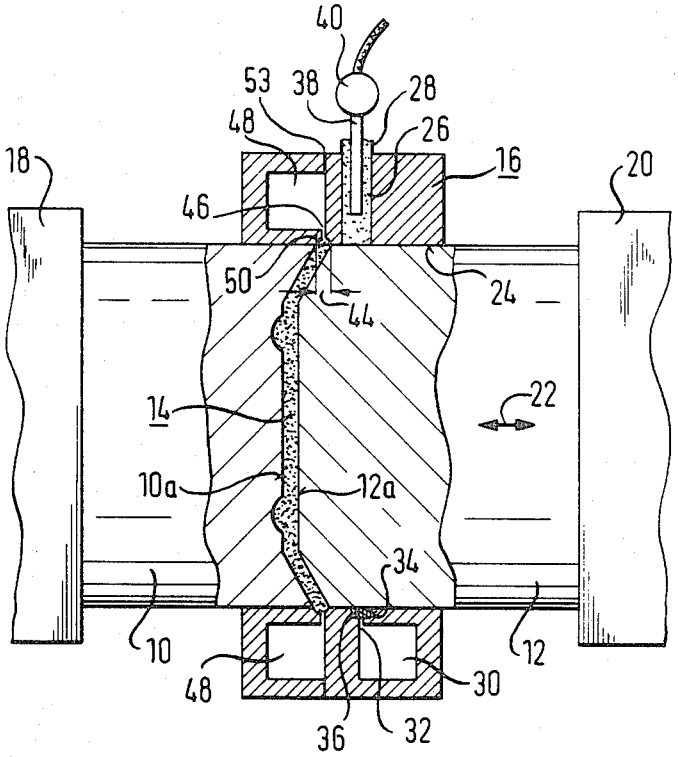
FIG. 3 is a side view partly in section, similar to that illustrated in FIG. 1, however, with the device shown in the pressing position.

In the drawings, the pressing mold is formed by two mold parts 10, 12. These mold parts have pressing mold faces 10*a*, 12*a* on their facing surfaces and together the mold faces 10*a*, 12*a* define the opposite surfaces of a hollow mold space 14. The mold parts 10, 12 each have a cylindrical outside surface of the same diameter and they are aligned with one another in the axial direction. Each of the pressing mold parts 10, 12 is connected to a corresponding clamping member 18, 20 of a press, the remainder of the press is not shown. The clamping members 18, 20 and the mold parts 10, 12 mounted on them can be moved toward and away from one another in the directions shown by the double-headed arrow 22.

In the filling position shown in FIG. 1, the pressing mold parts are in spaced relation relative to one another and an annular gap is formed around the circumference of the mold space 14 between the mold parts. An annular closure member 16 laterally encircles the gap about the mold parts 10, 12. The inner circumferential surface 24 of the closure member 16 is cylindrical with its diameter corresponding substantially to the outer diameter of the mold parts 10, 12. Closure member 16 has a filling passage 26 extending through it at its crown, note FIG. 1, so that the passage 26 extends substantially radially from the mold space 14. The filling passage 26 is connected to a filling line 28 in communication with a pourable substance supply container, not shown. In the filling position illustrated in FIG. 1, the filling passage 26 opens into the mold space 14.

In addition, a first partial annular channel 30 is located within the closure member 16 and the channel 30 is connected to a vacuum pump or a vacuum tank by a hose connection not shown in the drawing. The annular channel 30 extends substantially around the entire closure member 16 between the opposite sides of the filling passage 26. As can be seen in FIG. 2 the channel 30 extends for almost the entire circumferential direction of the closure member 16 with the exception of the space in the region of the filling passage 26. An annular slot 32 is connected at one end to the channel 30 and extends radially inwardly through the wall of the closure member 16. This annular slot 32 also extends substantially over the entire circumference of the closure member 16 with the exception of the region of the filling passage 26. An annular groove 34 is formed in the inner circumferential surface 24 of the closure member 16 and opens into the inner end of the annular slot 32. A fine-pored sintered ring 36 is seated within the groove 34 and the sintered ring is permeably to air.

In the filling position illustrated in FIG. 1, a vacuum is applied to the mold space 14 via the annular channel 30, the annular slot 32 and the sintered ring 36 and at the same time the pourable substance is introduced through the radially extending filling passage 26. A fluidized air line 38 containing a valve 40 projects into the radially extending filling passage 26. With the fluidized air valve 40 open during the introduction of the pourable substance into the mold space 14, the pourable substance is fluidized and its uniform distribution throughout the mold space is supported.

The fluidized air flow through the valve 40 and the line 38 and the application of the vacuum through the sintered ring 36 are adjusted so that, when the particles of the pourable substance contact the sintered ring 36, for instance when spray-dried porcelain substance particles are used, the particles are not destroyed and they do not interfere with the application of the vacuum.

When the filling operation is completed the flow of fluidized air through the valve 40 is cut off and the closure member 16 is displaced to the right as shown by the arrow 42 in FIG. 1. Accordingly, the closure member 16 is moved so that the filling passage 26 is moved out of alignment with the gap 44 between the mold surfaces 10*a*, 12*a*. Similarly, the sintered member 36 is moved out of alignment with the gap 44. This displacement can be seen in FIG. 3. When the closure member 16 is moved, another annular slot 46 in the inside circumferential surface of the closure member moves into alignment with the gap 44. Annular slot 46 at its radially outer end opens to another annular channel 48 located within the closure member 16. The annular channel 48 is also connected to a vacuum pump or a vacuum chamber via a hose connection, however, it can also be connected directly with the other annular channel or chamber 30. A ring-shaped groove 50 connects the radially inner end of the annular slot 46 with the inner circumferential surface of the closure member 16 and, accordingly, the ring groove 50 is in communication with the gap 44 between the mold surfaces 10*a*, 12*a*.

Subsequently, when the pressing operation is effected then the mold parts assume the pressing position as shown in FIG. 3. In this pressing position, the ring groove 50 and its associated slot 46 is aligned with the gap 44 so that the mold space 14 is completed by the groove 50 providing it with a bead-like form around its circumferential edge. In the pressing position, the annular channel 48 is connected to the mold space 14 through the annular slot 46 so that a vacuum is applied to the mold space during the pressing operation as well. This vacuum is maintained during the entire changeover from the position illustrated in FIG. 2 to the position shown in FIG. 3.

When the pressing operation is completed, the vacuum can be cut off. The mold parts 10, 12 are moved away from one another and the closure member can be opened along the joint face 53. In this position, the molded article can drop downwardly out of the mold space 14 onto a cushioned surface, not shown, and can then be transported for further processing.

While specific embodiments of the invention have been shown and described in detail to illustrate the application of the inventive principles, it will be understood that the invention may be embodied otherwise without departing from such principles.

We claim:

1. Device, for producing molded articles from a pourable substance, such as an oxide ceramic substance or a porcelain substance, comprising a pair of pressing mold parts disposed in facing relation and movable in the horizontal direction, each of said mold parts having an outer cylindrically shaped circumferential periphery, said mold parts being relatively movable between an open position and a closed position, in the closed position said mold parts are disposed in spaced relation forming a mold space therebetween with a laterally open gap between the outer circumferential peripheries of said mold parts and extending around the outer circumferential periphery of the mold space, an annular closure member having an inner cylindrical surface encircling the outer circumferential peripheries of said mold parts and forming a closure for the gap extending around the mold space, said closure member having a filling passage extending through said inner cylindrical surface and opening through said gap into said mold space, means forming a vacuum system openable through the gap into said mold space for establishing a vacuum within said mold space, and said closure member having an opening in the inner surface thereof connecting the vacuum system through said gap to said mold space, said opening extending in the circumferential direction around at least a major part of the circumference of said inner cylindrical surface of said closure member exclusive of the location of said filling passage, and said closure member is displaceable in the horizontal direction relative to the outer circumferential periphery of said mold parts from a filling position in which both said filling passage and said opening are in alignment with said gap opening into said mold space to a pressing position in which both said filling passage and said opening are disposed out of alignment with said gap opening into said mold space.

2. Device, as set forth in claim 1, wherein said vacuum system includes at least one partly annular slot formed in the inner circumferential surface of said closure member which aligns with said gap opening into said mold space in the filling position of said mold parts.

3. Device, as set forth in claim 2, wherein said filling passage can be closed for effecting the pressing operation.

4. Device, as set forth in claim 3, wherein said vacuum system is connected to said gap in the pressing position of said closure member.

5. Device, as set forth in claim 4, wherein at least one additional partial annular opening is provided in the radially inner circumferential surface of said closure member with said additional opening spaced in the horizontal direction from the other said opening and with said additional annular opening disposed in alignment with said gap in the pressing position of said closure member.

6. Device, as set forth in claims 1, 2, 3, 4 or 5, wherein said vacuum system in said closure member includes at least one annular channel therein.

7. Device, as set forth in claim 6, wherein a mesh insert is located in the opening of said vacuum system to said gap for preventing an obstruction of the opening by means of the fluidized substance introduced into said mold space.

8. Device, as set forth in claim 7, wherein said closure member has a recess formed in the inner circumferential surface thereof forming an annular recess positionable about said gap into said mold space, so that said recess forms a continuation of said mold space during the pressing operation.

* * * * *